US006491173B1

(12) United States Patent
Costa

(10) Patent No.: US 6,491,173 B1
(45) Date of Patent: Dec. 10, 2002

(54) WIRE BASKET SYSTEM

(75) Inventor: Kristine Costa, Lincroft, NJ (US)

(73) Assignee: Sidelines, Inc., Lincroft, NJ (US)

( * ) Notice: Subject to any disclaimer, the term of this patent is extended or adjusted under 35 U.S.C. 154(b) by 0 days.

(21) Appl. No.: 09/618,692

(22) Filed: Jul. 18, 2000

(51) Int. Cl.[7] ..... A47F 3/06

(52) U.S. Cl. ..... 211/126.15; 211/133.5; 211/162

(58) Field of Search ..... 211/126.15, 133.5, 211/162, 94.01, 90.02; 312/330.1, 334.1, 334.4

(56) References Cited

U.S. PATENT DOCUMENTS

| | | | | | |
|---|---|---|---|---|---|
| 1,132,190 | A | * | 3/1915 | Kohout | 211/94.01 X |
| 2,615,592 | A | | 10/1952 | Swedman | |
| 3,517,825 | A | * | 6/1970 | Propst | 211/126.15 |
| 3,966,157 | A | * | 6/1976 | Corral et al. | 248/217 |
| 3,973,814 | A | * | 8/1976 | Entrikin | 312/333 |
| 5,086,936 | A | * | 2/1992 | Remmers | 211/126.15 |
| 5,303,997 | A | * | 4/1994 | Kropf | 312/334.4 |
| 5,330,063 | A | | 7/1994 | Remmers | 211/162 |
| 5,775,786 | A | | 7/1998 | Liebertz | 312/334.8 |
| 6,109,462 | A | * | 8/2000 | Emalfarb et al. | 211/181.1 X |

FOREIGN PATENT DOCUMENTS

| | | | |
|---|---|---|---|
| DE | 43 35 742 A1 | | 4/1995 |
| DE | 198 42 666 | | 2/1999 |
| EP | 0 541 306 A1 | | 10/1992 |
| GB | 1 480 177 | | 7/1977 |
| GB | 2 231 783 A | * | 11/1990 |

* cited by examiner

*Primary Examiner*—Daniel P. Stodola
*Assistant Examiner*—Erica B. Harris
(74) *Attorney, Agent, or Firm*—Vidas, Arrett & Steinkraus P.A.

(57) ABSTRACT

A system for organizing a closet which comprises one or more pairs of slide rail assemblies and an appropriate number of baskets for mounting therebetween. Each rail assembly having an elongate mounting rail having at least one surface constructed and arranged to engage a partition, and an elongate slide rail, the elongate slide rail having at least one inner surface constructed and arranged to slidingly engage the elongate mounting rail. The elongate slide rail has an outer surface with a plurality of basket engaging hooks extending therefrom. The baskets have a double rim construction with one rim constructed and arranged to allows the baskets to be removingly secured to the hooks. A second rim being compatible with a U-channel slide. The basket may also be equipped with a pair of cross members which could be used to allows the basket to be received onto a roller slide. The hooks being flexibly adjustable so as to provide greater ability in securing a basket between the slide rails despite a lack of precise slide rail installation.

19 Claims, 8 Drawing Sheets

WIRE BASKET SYSTEM

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates to organizing a closet or other storage space with a unique sliding basket system. More particularly, the present invention is directed to a system of sliding rails and supported baskets. The sliding rails are unique in that they have a plurality of hooks which engage portions of the readily removable baskets. Once the baskets are engaged to the hooks the baskets may be slid on the sliding rails in a similar manner to a dresser drawer. The baskets may be freely lifted off of the hooks and be replaced as desired. In addition, the sliding rails may be fixed to any wall, support member or partition as desired, thereby allowing the rails to support a wide variety of basket shapes and sizes as well as providing for numerous configurations of slidable baskets within a storage space.

2. Description of the Related Art

As indicated above, the present invention is directed to storage space organization such as organizing closets. There are presently many products and services offered which claim to provide a consumer with a closet that is both organized and esthetically pleasing. Such closet organizer systems often have very specific partition widths and must be erected with great precision to provide for proper functioning of the system. As a result, many organizers require installation by professional designers and/or installers at significant expense to the consumer. These closet systems are often made of wood and/or laminate modules which partition the closet into compartments, with the various compartments corresponding to different types of items to be stored. The use of baskets in such systems is known. However, the present invention improves upon prior art systems by providing a sliding basket system which may be installed in a variety of configurations within a storage space. The present invention provides a system which is functional, esthetically pleasing, and which may be installed without a great degree of precision required.

BRIEF SUMMARY OF THE INVENTION

The present invention is directed to a system for organizing a storage space which includes a unique type of storage basket. An additional element of the present system may also include a new slide assembly which may be used with the aforementioned basket. The basket has an inventive double rim which enables a user to use the basket with known, notched, single or full, extension slides and roller slides, or the basket may be mounted onto the unique slide assembly described in greater detail below. The present slide assembly has several mounting hooks which are constructed and arranged to receive portions of the basket rims.

The present double rimmed basket and rail assembly provides for an organizational system wherein the spacing provided for the basket between slide assemblies does not have to be as precise as is required by many prior art systems. In at least one embodiment of the present invention the respective rims of the double rim basket have different spacings, with at least one rim being wider than the remaining portions of the basket. By providing a basket which has more than one size of mounting surface, the present basket may be placed onto and between slide assemblies having a variety of spacings. Additionally, in at least one embodiment of the invention, the hooks of the slide assembly may be flexible or otherwise adjustable, thereby providing the slide assemblies themselves with at least a limited ability to vary the basket mounting space provided.

BRIEF DESCRIPTION OF THE SEVERAL VIEWS OF THE DRAWINGS

A detailed description of the invention is hereafter described with specific reference being made to the drawings in which:

FIG. 9 is a perspective view of a known roller slide assembly which may be used with the basket shown in FIG. 2.

DETAILED DESCRIPTION OF THE INVENTION

Figure 1:
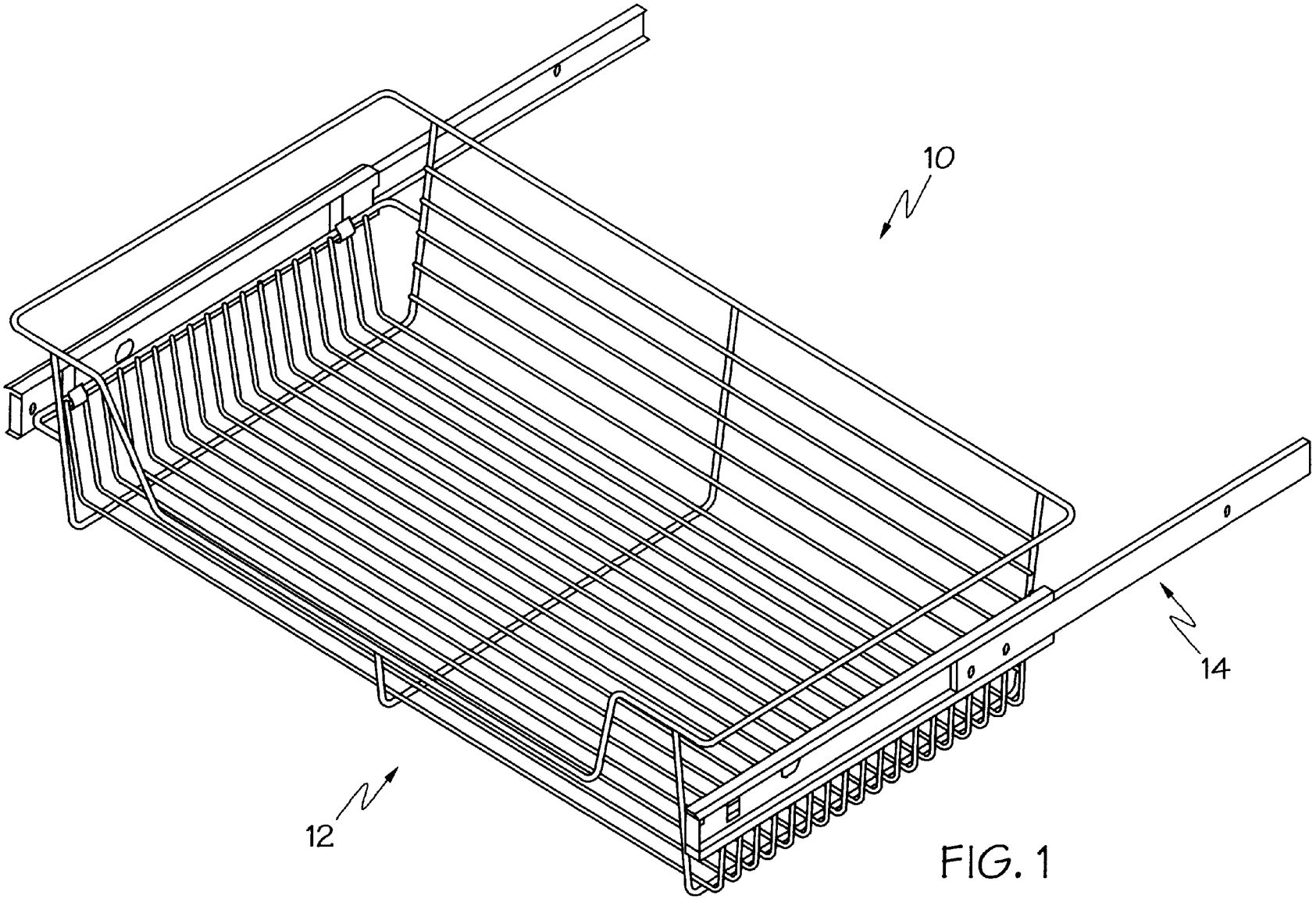
FIG. 1 is a perspective view of an embodiment of the present sliding basket system.

FIG. 1 illustrates an embodiment of the present sliding basket system, indicated generally at 10. As previously stated the present system 10 includes a unique type of basket 12, and a pair of sliding rail assemblies 14. As will be discussed in greater detail below, both the basket 12 and rail assemblies 14 have unique features which allow the present system 10 to have a much greater tolerance for imprecise rail mounting and spacing.

Figure 2:
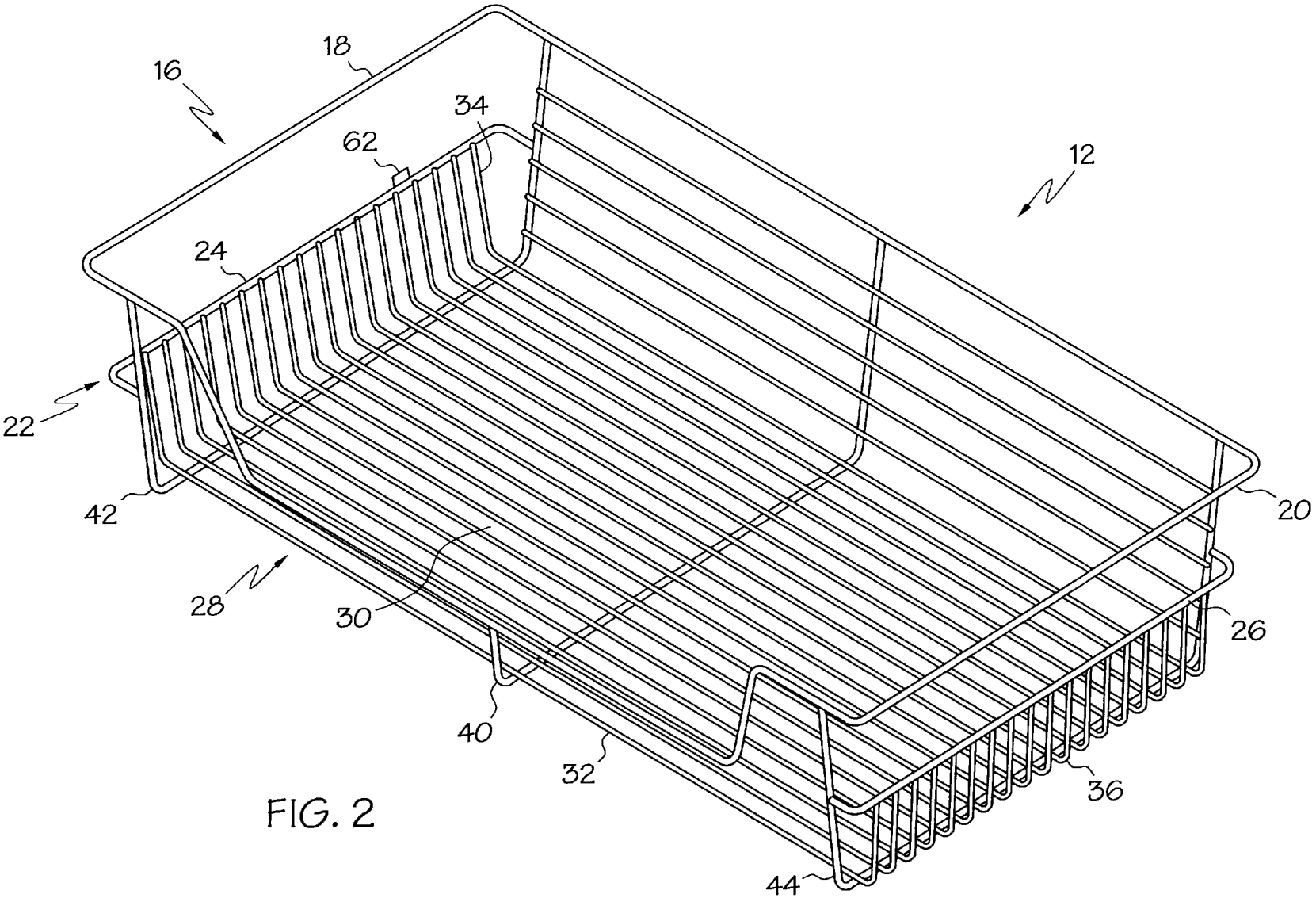
FIG. 2 is a perspective view of an embodiment of the basket.

FIG. 2 shows an embodiment of a basket 12 which may be utilized in the system 10 shown in FIG. 1. As may be seen, the present basket 12, has multiple rims or frames 16 and 22. The first, or top rim 16 has two rim members 18 and 20 which are substantially parallel to one another and have a spacing wider than the spacing of the second or middle rim 22. Like, the top rim 16, the middle rim 22 has two substantially parallel rim members 24 and 26 which define the general width of the substantially U-shaped members 28 which make up the basket base 30. The rims 16 and 22 may form a continuous border around the basket, such as first rim 16, or the rims may be configured to have two unconnected rim members such as 24 and 26 of the second rim 22. The rims 16 and 22 have rim members which are spaced apart by different distances. As a result the present invention may be used with at least two different slide bar widths as mentioned above.

Each of the U-shaped members 28 have a middle or base portion 32, as well as upturned end portions 34 and 36. The U-shaped members 28, like the other components of the basket 12 referred to in the present embodiment, may be constructed from a variety of materials such as metal, wood, wicker, plastic or other suitable material for making baskets.

Figure 4A:
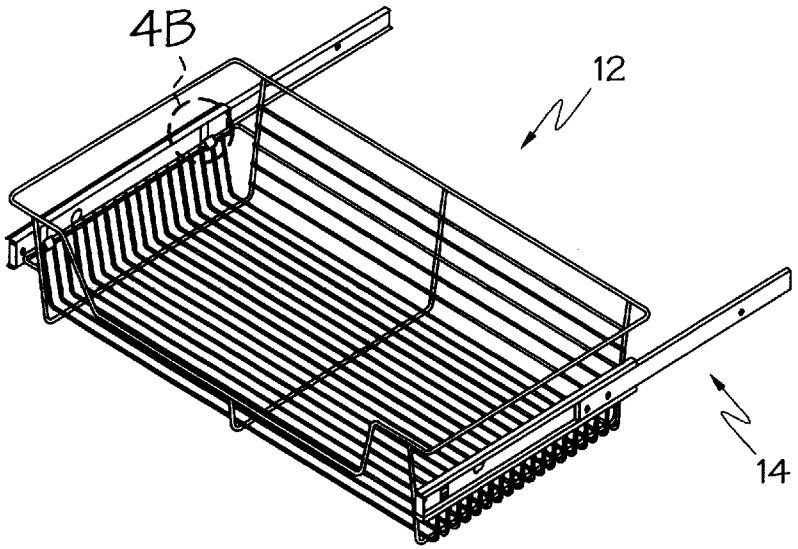
FIGS. 4A and 4B are a close-up perspective view of a portion of an embodiment of the rail assembly.

In the embodiment shown, the ends 34 and 36 of the U-shaped members 28 are angled in an upward direction relative to the base 30. The ends 34 and 36 are connected to middle rim members 24 and 26 in the manner shown. The ends may be connected to the rim members in a variety of manners including but not limited to welding, adhesively bonded, fastening, etc. In the embodiment shown, the ends 34 and 36, as well as the base portions 32 are spaced evenly apart. While such spacing is not required, the spacing between each of the ends 34 and 36 must be sufficient to allow a hook or tab 60 to be inserted into the space 62 therebetween to supportingly engage the rim members 24 and 26 such as is shown in FIGS. 4 and 5. In an alternative embodiment, the U-shaped members 28 may be substituted with a sheet of material having properly sized holes to allow the passage of the hooks 60. In yet another alternative embodiment the entire basket 12 may be pre-molded plastic having adequately sized holes or spaces 62 to allow the passage of the hooks 60 therethrough.

In addition to the elements described above, the basket 12 may have additional supports and members to reinforce the base 30 or provide extra structural support for those embodiments intended to be used for heavier loads. For example, basket 12 may be equipped with one or more cross-members such as cross-members 40, 42 and 44. Cross-members 40, 42 and 44 may be fastened or otherwise engaged to the U-shaped members 28 to provide additional base support. As may be seen, the cross-members 40, 42, and 44 may also be substantially U-shaped and have ends which extend toward portions of the first and second rims 16 and 22 and are engaged thereto.

To provide uniform support of the base 30, the cross-members will typically be positioned in a manner perpendicular to the U-shaped members 28 as well as to the rim members 18, 20, 24 and 26. However, other configuration could be used such as providing. the base with one or more X-shaped, S-shaped or other types of support(s).

In the embodiment shown in FIG. 2 the cross-members 42 and 44 may also be used to engage an open top slide such as are known in the art. The cross-members 42 and 44 may be spaced a part a distance which is different than either of the first or second rims 16 and 22. As a result cross-members 42 and 44 may provide the basket 12 with yet another manner in which to engage a pair of slide rails, wherein the slide rails may have a spacing less than that of the first or second rims 16 and 22.

Figure 3:
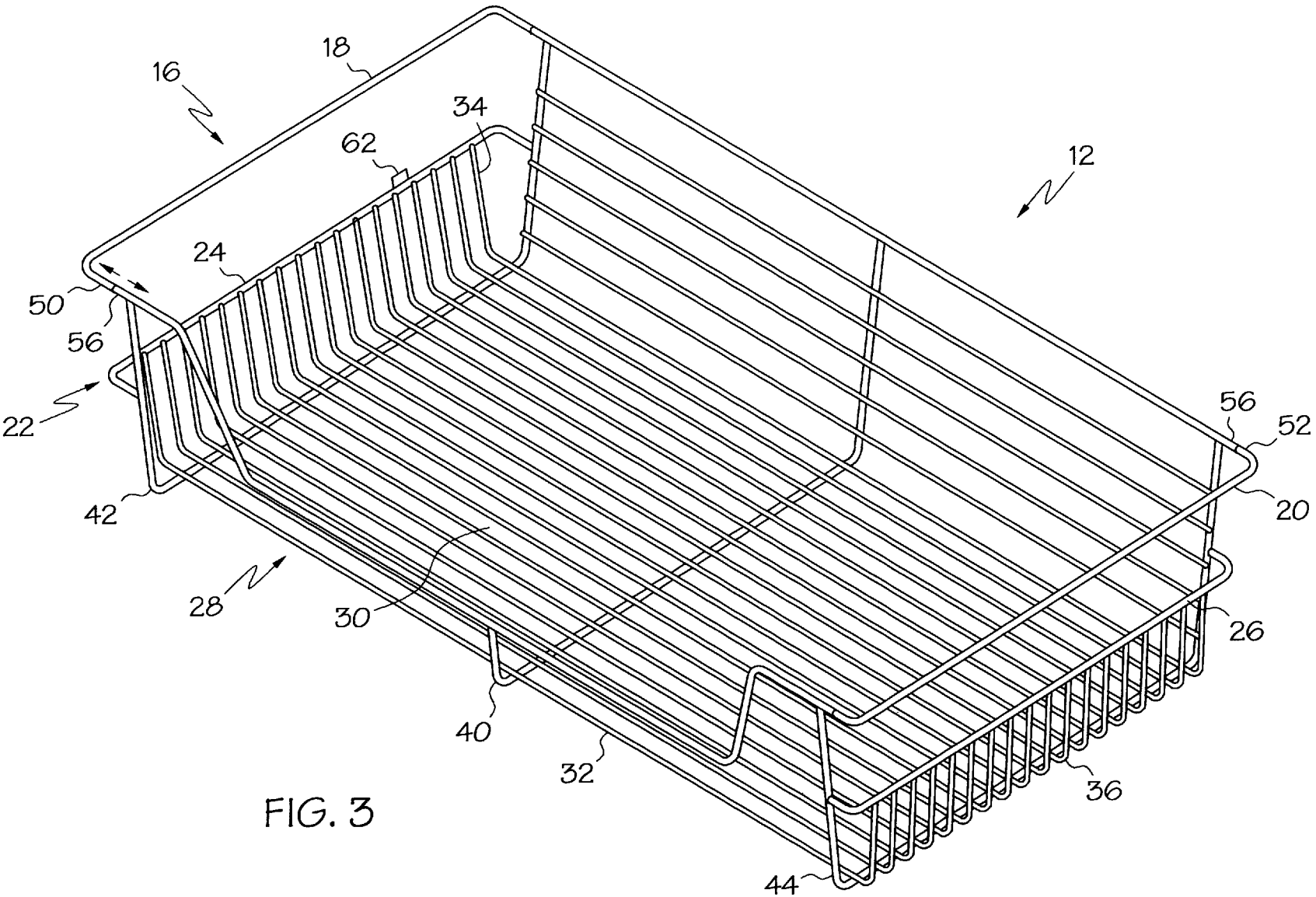
FIG. 3 is a perspective view of an embodiment of the basket.
Figure 8:
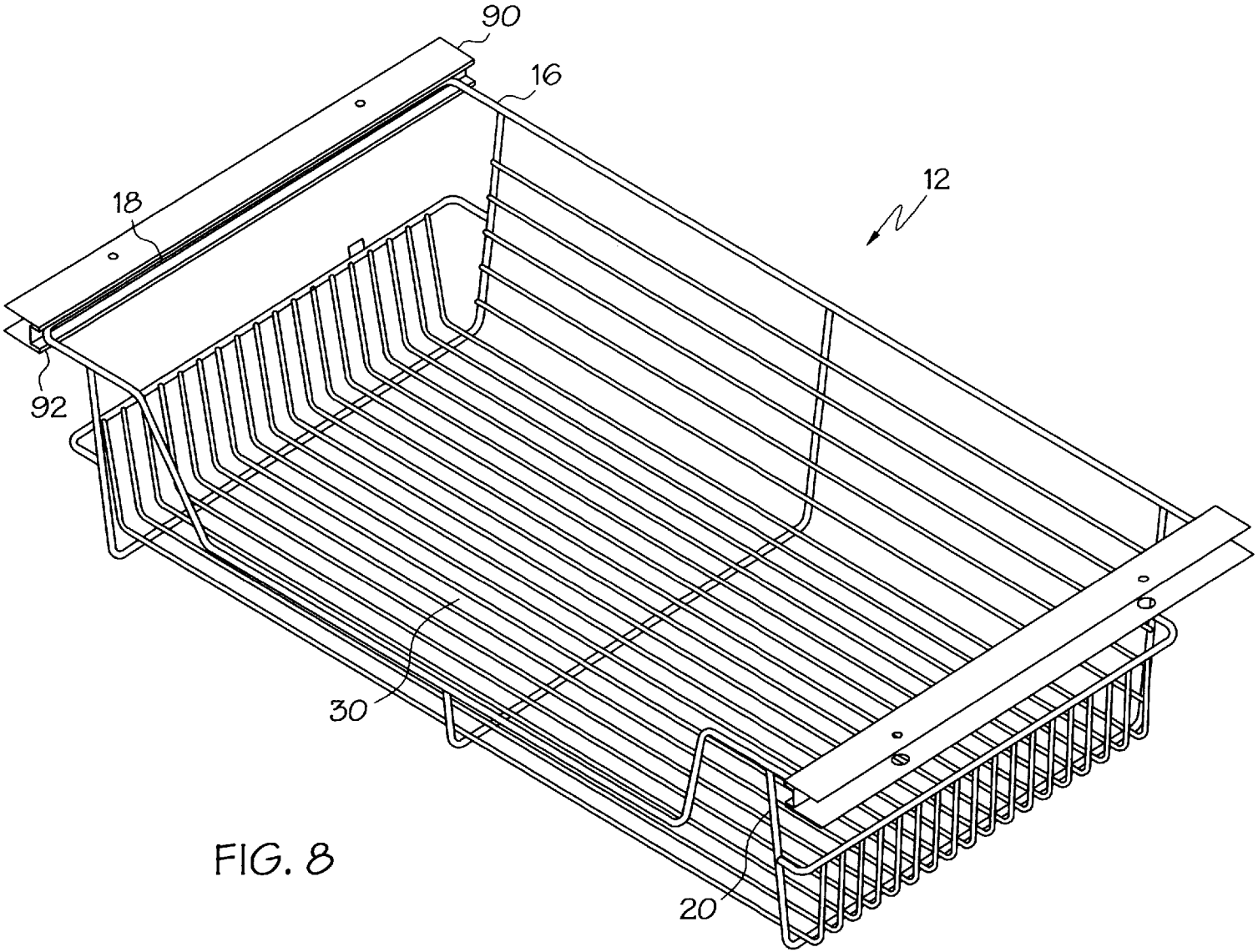
FIG. 8 is a perspective view of another embodiment of the present sliding basket system which utilizes the basket shown in FIG. 2 and rail assembly shown in FIG. 7.

FIG. 3 shows an alternative embodiment of the basket 12, wherein the first rim 16 has rim members 18 and 20 which may be adjusted so as to vary the distance therebetween, thus allowing the first rim to be adjusted to the corresponding spacing of channel rails 90 such as may be seen in FIG. 8.

In the present embodiment the rim members 18 and 20 have end portions 50 and 52 which are slidingly received into hollow receiving portions 54 and 56 of the first rim 16. The end portions 50 and 52 have a predetermined length which is at least half the length of the hollow receiving portions 54 and 56, as a result the end portions may be adjusted by being pushed further into the respective hollow receiving portions or being pulled outward from the hollow receiving portions, without removing the ends 50 and 52 completely. The ends 50 and 52 may be receivably engaged by the hollow receiving portions 54 and 56 through a variety of mechanisms such a may be know in the art. In the embodiment shown, the ends and hollow receiving portions are frictionally engaged.

As stated above, the basket 12 may be used with a variety of sliding rail assemblies. However, it is believed that the basket 12 will be most fully appreciated by a consumer when it is used in conjunction with the unique sliding rail assemblies 14 such as those shown in FIG. 1 and depicted in partial detail in FIG. 4B.

Extension slides are known in the art and typically comprise a mounting rail 64 which is screwed or otherwise attached to a wall, partition or other structure; and a slide 66 which is partially disposed about the rail 64 and which may be constructed and arranged to have a drawer, basket or other storage device affixed thereto. Unlike, prior slide rail assemblies, each of the present sliding rail assemblies 14, as depicted in FIGS. 1 and 4–6 are equipped with at least two tabs or hooks 60 which are sized appropriately to removably receive portions of the middle rim 22 of the basket 12 such as previously described.

Figure 4B:
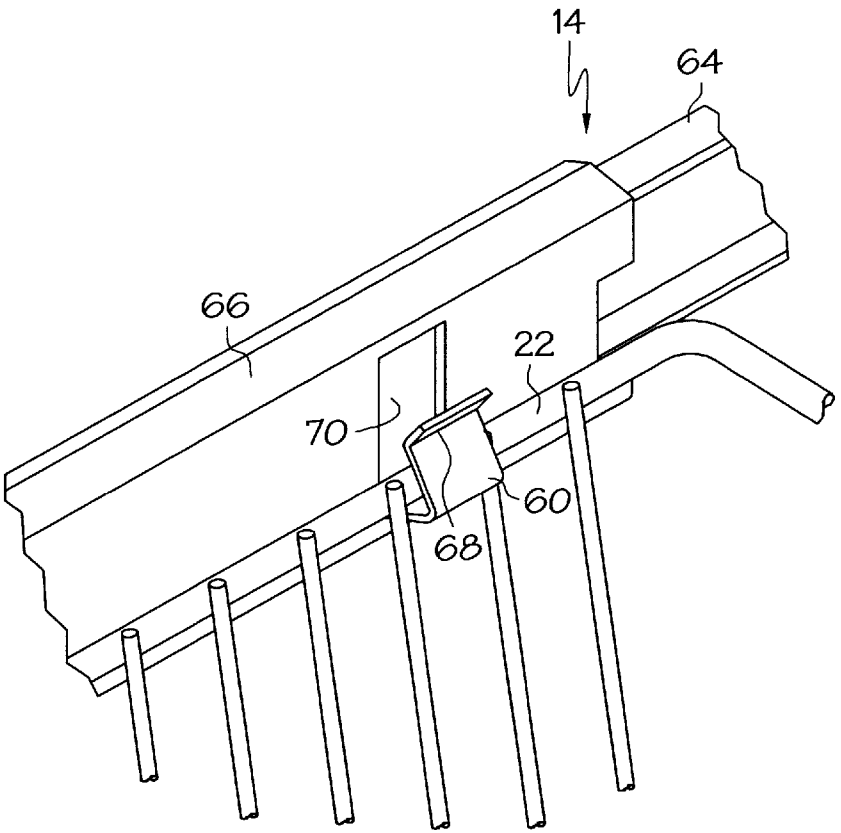

In the embodiment shown in FIG. 4B, the hooks 60 are provided for by cutting out three sides of a rectangular tab of material from the slide 66. The tab has a width which is less than that of the spacing between the ends 34 and 36 of the U-shaped support members 28. The cut tab or hook 60 is then bent or tooled into a position appropriate to receive a portion of the rim 22 as shown. The use of hooks 60 allows a user to freely engage a basket 12 into place between the rail assemblies 14 in the manner depicted in FIG. 6. The basket is merely pushed downward between the slides 66 and the rim 22 placed onto the hooks 60. The hooks 60 may be configured with one or more bends 68 to provide for a predetermined radius 70. The radius portion 70 is constructed to allow the rim 22 to be "snapped" into place, thereby ensuring proper placement of the basket 12. The radius 70 may be constructed to provide a rim 22 with up to approximately 0.125 inches of give space between the hook 60 and the slide 66, thereby allowing the basket 12 to be adjustably positioned within the radius 70 of the hooks 60 by up to approximately 0.25 inches.

In addition, the flexible nature of the hooks 60 is such that the hooks may be reoriented to allow the basket even greater position adjustability than is provided only by the radius 70, allowing the basket to be readily removed and replaced as may be desired by the user. The flexibility of the hooks 60, allows the hooks to be adjusted or "re-bent" to increase or decrease the distance the hook protrudes away from the slide 66 thereby allowing improperly spaced slide rail assemblies 14 to still be able to accept a basket therebetween. Depending on the size of the slide 66 and the hooks 60 the increase (or decrease) in distance for each hook 60 will be approximately 0.25 inches or less. Therefore the spacing of hooks on opposing slide rail assemblies 14 may be adjusted by approximately 0.5 inches or less.

In the embodiment shown, the material of the slide rail assembly 14 is substantially metal, however the various components of the slide rail assembly may be constructed from other materials such as plastic. Where the slide 66 is constructed from molded plastic, the slide rail 66 may be molded to include hooks 60 rather than require the hooks to be cut from the slide material as described. Regardless of the material the slide 66 is constructed from, in alternative embodiments the slide 66 may have separate hooks of various construction attached to the slide to provide for the basket 12 to be mounted thereto.

The slide rail assemblies 14, may additionally include wheels, ball-bearings or other features which are known in the slide rail art to assist in the sliding action between the rail 64 and slide 66.

The hooks 60 are constructed and arranged to be capable of engaging any of the first or second rims 16 and 22, as well as members 42 and 44 depending on the spacing provided for between the slide rail assemblies 14.

Figure 5B:
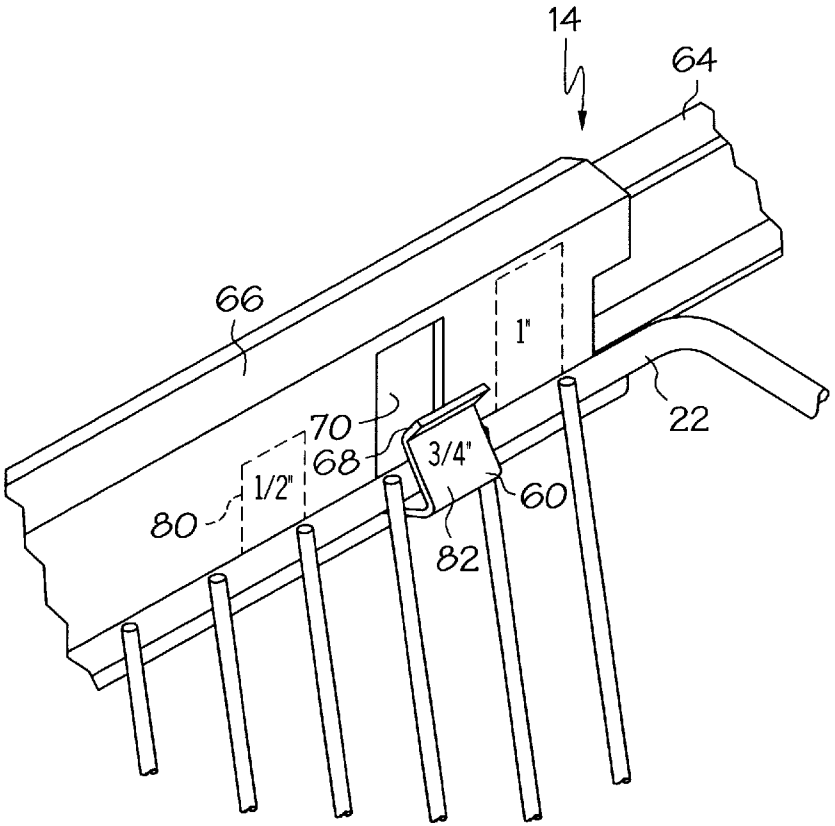
FIGS. 5A and 5B are a close up perspective view of a portion of an embodiment of the rail assembly.
Figure 5A:
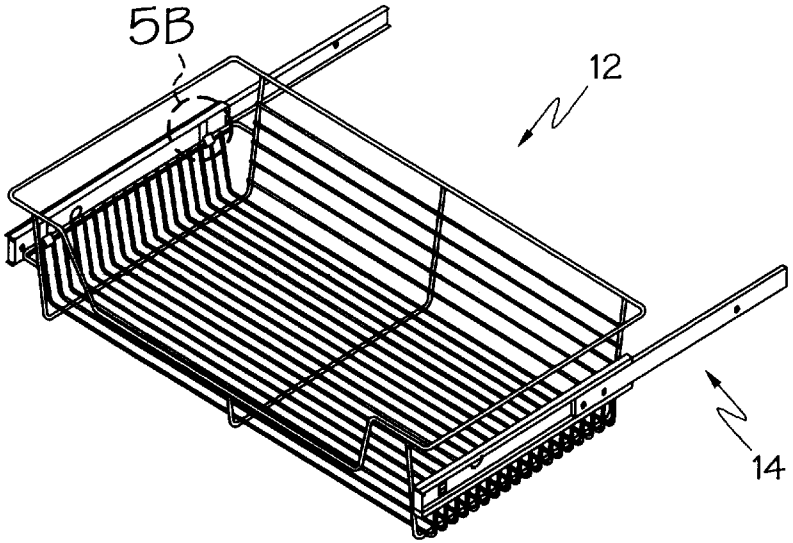
Figure 6:
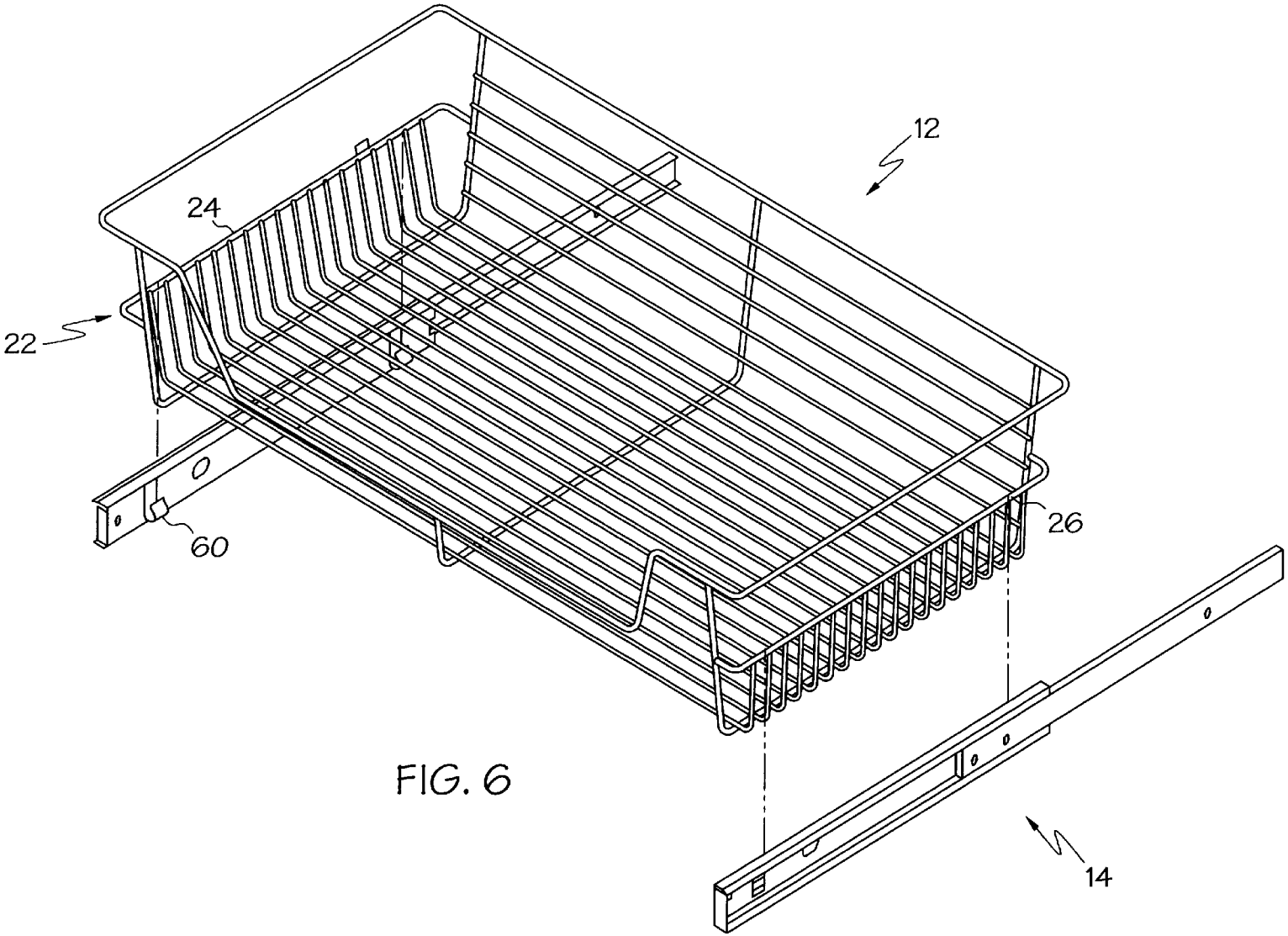
FIG. 6 is a perspective view of the embodiment shown in FIG. 1 wherein the basket and rails are separated.

In FIGS. 5A and 5B, an alternative embodiment of the slide rail assembly 14 is shown. In the present embodiment the slide 66 has more than one pre-cut hook 60. In the embodiment shown, each pre-cut hook 60 is a different length. Alternatively the pre-cut hooks could all be the same size if desired. The pre-cut hooks 60 are constructed by outlining a hook 60 of desired size with a perforated border 80. The use of a perforated border 80 allows a hook of a desired size to be pushed out of the slide material 66 as desired by the user. By providing a variety of hooks of different lengths, the spacing between slide rail assemblies 14 may be adjusted up to a full inch without requiring the hooks to be distorted or other wise re-bent in the manner discussed above. It should be noted that in the present embodiment, the only limitation on the length of the hook 60 is the size of the slide 66 from which the hooks 60 are formed.

As shown in FIG. 5B, the pre-cut hooks 60 may have labels 82 indicating their respective lengths. In addition, the hooks 60 may also include indentations or bend lines 84 to indicate the manner in which the hook 60 should be bent to provide for ideal rim engagement, such as previously discussed.

Figure 7:
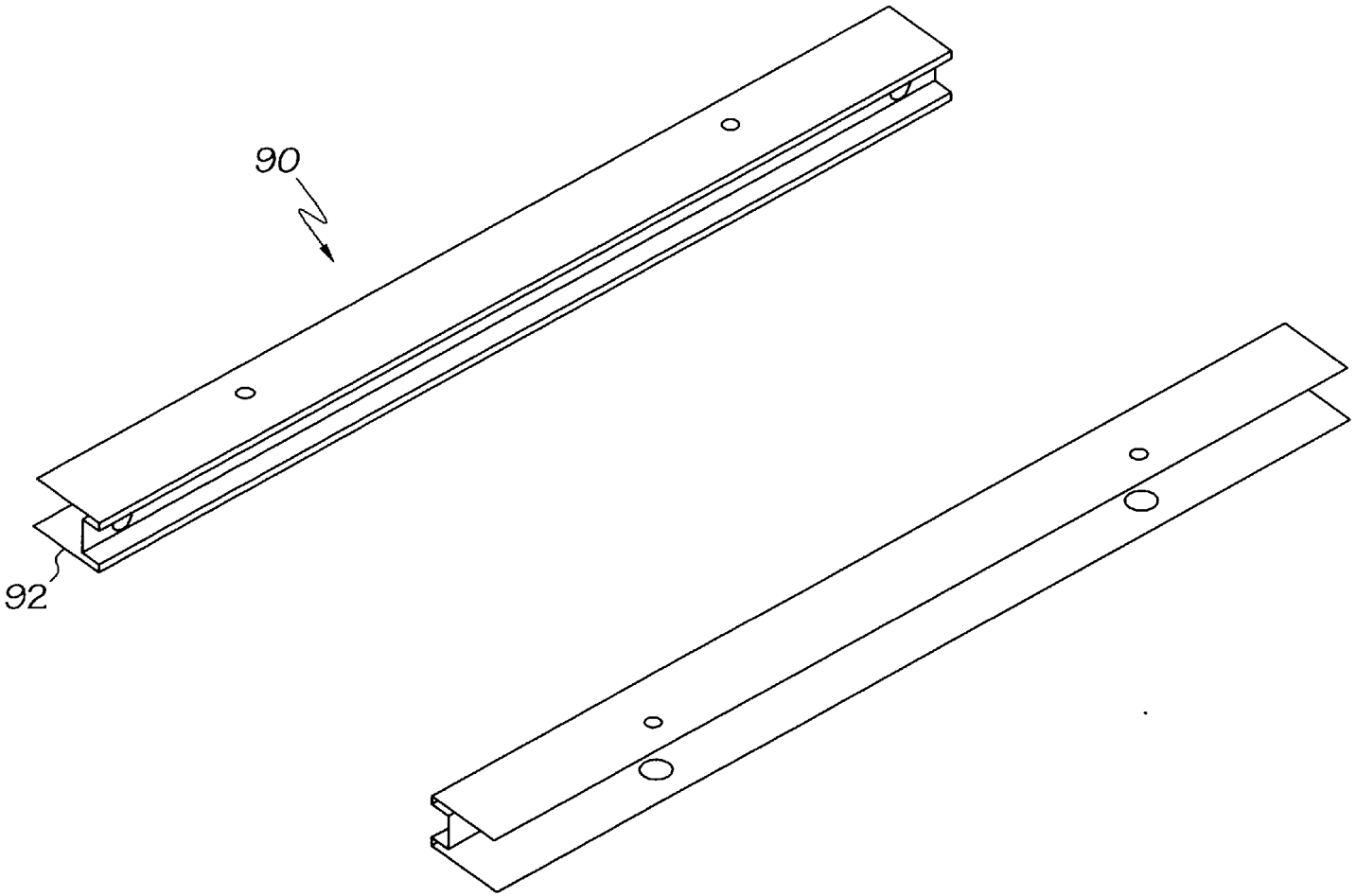
FIG. 7 (PRIOR ART)
FIG. 7 is a perspective view of a second type of rail assembly which may be used with the present basket shown in FIG. 2.

As was mentioned previously the basket 12 may be used with the unique slide rail assembly 14 discussed above as well as other types of rail assemblies. In FIG. 7, a pair of prior art U-channel slides 90 are shown. As depicted in FIG. 8, the basket 12 of the present invention, may be used with this type of slide. As previously stated, the basket 12 has a double rim construction. The first or top rim 16 is made up of rim members 18 and 20, the rim members extend beyond the width of the base 30 of the basket 12 and are not interfered with by other components of the basket 12. As a result the rim members 18 and 20 may be slidingly engaged within the U-channel 92 of the U-channel slide 90 in the manner shown in FIG. 8.

It is clear from the inventive features shown of the various embodiments shown herein that the present inventive basket 12 may be used with a variety of different slide and slide rail assemblies, include the unique slide rail assembly 14 described herein. Furthermore, the combination of basket 12 and slide rails 14 provides a unique basket and slide rail system 10 which is very useful in organizing a space such as a closet. The system 10 may be installed by nearly any consumer, even those of limited skill because the various features described above allow for the spacing of the slide rail assemblies to be readily adjusted. In addition, the various engagement rims of the basket allow for a wide variety of spacing and placement options.

The use of multiple systems 10, of one or more sizes provides a user with the ability to organize any size storage space without the need for a professional installer or organizer service.

In addition to being directed to the embodiments described above and claimed below, the present invention is further directed to embodiments having different combinations of the features described above and claimed below. As such, the invention is also directed to other embodiments having any other possible combination of the dependent features claimed below.

The above examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A bar slide for mounting a basket thereto comprising:

an elongate mounting rail having at least one surface constructed and arranged to engage a partition;

an elongate slide rail, the elongate slide rail having at least one inner surface constructed and arranged to slidingly engage the elongate mounting rail, the elongate slide rail having an outer surface, the outer surface having a plurality of flexible hooks, the hooks being constructed and arranged to supportingly and releasably engage at least one member of a basket, the at least one member being substantially parallel to the elongate slide rail.

2. The bar slide of claim 1 wherein the plurality of hooks are metal.

3. The bar slide of claim 1 wherein the plurality of hooks have a predetermined radius, the predetermined radius of each hook being constructed and arranged to provide the at least one member with up to about 0.125 inches of space between each of the plurality of hooks and the outer surface.

4. The bar slide of claim 1 wherein the plurality of hooks form a first configuration and at least one second configuration, the hooks constructed and arranged to be flexibly moved between the first position and the at least one second position.

5. The bar slide of claim 4 wherein each of the plurality of hooks is constructed and arranged to be reformed and thereby extend at least 0.25 inches away from the elongate slide rail.

6. The bar slide of claim 1 wherein each of the plurality hooks comprises a substantially rectangularly shaped portion of at least the outer surface of the elongate slide rail, the substantially rectangularly shaped portion being defined by a three-sided cut out portion of the at least the outer surface of the elongate slide rail.

7. The bar slide of claim 6 wherein the plurality of hooks have at least one predetermined bend location, the at least one predetermined bend location being visibly indicated on the rectangularly shaped portion.

8. The bar slide of claim 6 wherein at least two of the plurality of hooks are different sizes.

9. The bar slide of claim 6, wherein the cut out portion is defined by a perforated border.

10. The bar slide of claim 6 wherein each of the plurality of hooks has a label, the label indicating the length of the hook.

11. A basket for use with a bar slide, comprising:

a plurality of support members, the plurality of support members being substantially parallel to one another, the plurality of support members each being substantially U-shaped and having a first end, a second end and a middle section and a predetermined length;

at least two cross-members, each of the at least two cross-members supportingly engaged to a portion of the middle section of the support members, the at least two cross-members having ends, the ends of the cross-members extending beyond the first and second ends of the support members;

a first rim assembly, the first rim assembly securingly engaged to the ends of the at least two cross members, the first rim assembly having a first rail member and a second rail member, the first rail member and the second rail member being substantially parallel to one another, the first and second rail members being spaced a predetermined distance apart, the predetermined distance that the rail members are spaced apart being greater than the predetermined length of the plurality of support members; and a second rim assembly, the second rim assembly comprising at least two rim members, the at least two rim members being substantially parallel to one another and being spaced a predetermined distance apart, the first ends of the plurality of support members being securely engaged to a first rim member, the second ends of the plurality of support members being securely engaged to a second rim member, the ends of the support members having a predetermined spacing between one another such that one or more hooks may be supportingly and releasably engaged to the rim members.

12. The basket of claim 11 wherein the basket is manufactured from at least one member of the group consisting of metal, plastic, metal wire, wood, wicker and any combination thereof.

13. The basket of claim 11 wherein the predetermined spacing of the support members is substantially uniform.

14. The basket of claim 11 wherein the at least two cross-members are positioned substantially perpendicular to the support members.

15. The basket of claim 11, the rail members of the first rim assembly further comprising:

end portions, the end portions being substantially parallel to the support members, the end portions having a predetermined length; and receiving portions, the receiving portions constructed and arranged to receivingly engage the end portions, the receiving portions having a predetermined length which is greater than the predetermined length of the end portions of the rim members.

16. The basket of claim 11 wherein the basket is constructed and arranged to be removably received by at least one member of the group consisting of: a U-channel slide assembly, a roller slide assembly, a slide rail assembly and any combination thereof.

17. A system for organizing a closet comprising:

(a) at least one pair of slide rail assemblies, each slide rail of a pair being a predetermined distance apart and comprising:

an elongate mounting rail having at least one surface constructed and arranged to engage a partition, an elongate slide rail, the elongate slide rail having at least one inner surface constructed and arranged to slidingly engage the elongate mounting rail, the elongate slide rail having an outer surface, the outer surface having a plurality of hooks;

(b) at least one basket comprising:

a plurality of support members, the plurality of support members being substantially parallel to one another, each of said plurality of support members being substantially U-shaped and having a first end, a second end and a middle section and a predetermined length;

at least two cross-members, each of the at least two cross-members being supportingly engaged to a portion of the middle section of the support members, the at least two cross-members having ends, the ends of the cross-members extending beyond the first and second ends of the support members;

a first rim assembly, the first rim assembly securingly engaged to the ends of the at least two cross members, the first rim assembly having a first rail member and a second rail member, the first rail member and the second rail member being substantially parallel to one another, the first and second rail members being spaced a predetermined distance apart, the predetermined distance which the rail members are spaced apart being greater than the predetermined length of the plurality of support members;

a second rim assembly, the second rim assembly comprising at least two rim members, the at least two rim members being substantially parallel to one another and being spaced a predetermined distance apart, the first ends of the plurality of support members securingly engaged to a first rim member, the second ends of the plurality of support members securingly engaged to a second rim member, the ends of the support members having a predetermined spacing between one another such that each of the plurality hooks may be supportingly and releasably engaged to the rim members.

18. The system of claim 17 wherein the plurality of hooks are integral with the elongate slide rail and extend therefrom.

19. The system of claim 17 wherein the hooks may be flexibly adjusted to change the predetermined distance between the at least one pair of slide rail assemblies.

* * * * *